US009280921B2

(12) United States Patent
Skauge Johannesen

(10) Patent No.: US 9,280,921 B2
(45) Date of Patent: Mar. 8, 2016

(54) DISPLAY DEVICE FOR DISPLAYING INFORMATION, COMMERCIALS, AND TRAFFIC SIGNS

(71) Applicant: LSA AS, Tønsberg (NO)

(72) Inventor: Arne Skauge Johannesen, Horten (NO)

(73) Assignee: LSA AS, Tønsberg (NO)

( * ) Notice: Subject to any disclaimer, the term of this patent is extended or adjusted under 35 U.S.C. 154(b) by 0 days.

(21) Appl. No.: 14/374,459

(22) PCT Filed: Jan. 23, 2013

(86) PCT No.: PCT/EP2013/051223

§ 371 (c)(1),
(2) Date: Jul. 24, 2014

(87) PCT Pub. No.: WO2013/110646

PCT Pub. Date: Aug. 1, 2013

(65) Prior Publication Data

US 2014/0373405 A1 Dec. 25, 2014

(30) Foreign Application Priority Data

Jan. 24, 2012 (NO) ..... 20120072

(51) Int. Cl.

| | |
|---|---|
| ***G09F 19/00*** | (2006.01) |
| ***G09F 9/40*** | (2006.01) |
| ***G09F 9/30*** | (2006.01) |
| ***G09F 9/46*** | (2006.01) |

(Continued)

(52) U.S. Cl.

CPC .. *G09F 9/40* (2013.01); *G09F 9/30* (2013.01); *G09F 9/46* (2013.01); *G09F 13/00* (2013.01); *G09F 13/24* (2013.01)

(58) Field of Classification Search

CPC .... G09F 13/24; F21S 10/002; F21W 2121/02
USPC ..... 40/406, 477, 612; 446/267
See application file for complete search history.

(56) References Cited

U.S. PATENT DOCUMENTS

| | | | | |
|---|---|---|---|---|
| 1,458,840 | A | 6/1923 | Montgomery et al. | |
| 3,058,245 | A * | 10/1962 | Pieters | 40/406 |
| 3,321,857 | A | 5/1967 | Schroer | |

(Continued)

FOREIGN PATENT DOCUMENTS

| | | |
|---|---|---|
| DE | 38 44 583 A1 | 3/1990 |
| EP | 1 862 874 A2 | 12/2007 |
| SE | 220 629 | 3/1968 |

OTHER PUBLICATIONS

International Search Report for corresponding International Application No. PCT/EP2013/051223, mailed May 28, 2013 (2 pages).

(Continued)

*Primary Examiner* — Joanne Silbermann
(74) *Attorney, Agent, or Firm* — Osha Liang LLP

(57) ABSTRACT

A display device for displaying information comprises a display body having a front side and rear side and comprising at least one cavity between them. The cavity is connected in a closed fluid circuit comprising supply fluid lines, return fluid lines and a fluid reservoir and the circuit is suitable to contain a colored fluid. There is also arranged a pump for circulating colored fluid in the fluid circuit. The cavity is shaped to form symbols representing the information to be displayed when filled with colored fluid.

20 Claims, 7 Drawing Sheets

(51) Int. Cl.
*G09F 13/24* (2006.01)
*G09F 13/00* (2006.01)

(56) References Cited

U.S. PATENT DOCUMENTS

| | | | | |
|---|---|---|---|---|
| 3,388,490 | A | 6/1968 | Stechemesser | |
| 4,144,663 | A * | 3/1979 | Saenger et al. | 40/406 |
| 2002/0112383 | A1 * | 8/2002 | Butcher | 40/406 |
| 2007/0280839 | A1 | 12/2007 | Furetta | |

OTHER PUBLICATIONS

International Preliminary Report on Patentability for corresponding International Application No. PCT/EP2013/051223, mailed May 28, 2013 (7 pages).
Search Report for Norwegian Application No. 20120072, mailed Aug. 2, 2012 (2 pages).

* cited by examiner

DISPLAY DEVICE FOR DISPLAYING INFORMATION, COMMERCIALS, AND TRAFFIC SIGNS

FIELD OF THE INVENTION

The invention relates to display devices for information, commercials, traffic signs, etc. where the information should be able to change over time by changing or removing symbols.

BACKGROUND

Changing information displays are commonly used, in particular related to commercials. Also in other areas, such as traffic signs, there is a need for the ability to change the information that is displayed, such as speed limits, re-routing information, closed roads, etc.

Today the most commonly used changeable displays/signs make use of LED or LCD. These types of displays, however, are not suitable in very light environments (such a bright sunshine) as they have too low contrast and visibility. This is particularly a problem with road signs.

It has earlier been suggested to use liquid-filled signs where the liquid can be filled or drained in order to change information, but such signs have so far not been successful, probably due to lack of flexibility, and leakage. SE 220629 describes an indication device for traffic, commercials, etc. which comprises a transparent board arranged with cavities which may be filled to be visible. This device needs backlight to be visible, has many pumps and sealings that can cause leakage and is not suitable for very low or very high temperatures.

U.S. Pat. No. 1,458,840 describes a sign with a sign plate pervious to light rays and a closed space defining a sign character. The space is filled with liquid by a plunger activated by an electro magnet and emptied by gravity through the same pipes. The signs are visible only when the electro magnet is active, thus demanding continuous power supply when the information is displayed.

EP 1862874 describes a display device fitted to a watch having cavities which may be filled by a fluid by means of a micropump and microvalves. The microvalves alternately pumps and sucks the fluid to fill and empty the cavities.

SUMMARY

One or more embodiments of the present invention provide a changeable display device which alleviates at least some of the problems of prior art and which does not demand backlighting to display information.

According to one or more embodiments of the present invention a display device for displaying information comprises a display body having a front side and rear side and comprising at least one cavity between them, the cavity being connected in a closed fluid circuit comprising supply fluid lines, return fluid lines and a fluid reservoir, the circuit being suitable to contain a coloured fluid and the cavity being shaped to form symbols representing the information to be displayed. The display device also comprises a pump for circulating coloured fluid in the fluid circuit. There may be a coloured fluid in the closed circuit, and the coloured fluid may be a coloured liquid.

The display body is in one or more embodiments at least partly transparent. At least the part of the display body between the front side and the cavities should be transparent.

The display device according to one or more embodiments of the present invention may comprise a light source arranged at the rear side or the front side of the display device.

The back surface of the display body may be partly or fully covered by a colour. The areas of the display body which are transparent may in one or more embodiments be covered by a coloured paint. The coloured paint may also be reflective in order to use ambient light to improve visibility.

In one or more embodiments the display body is made of a plastic material. The material of the display body should be weather proof, have a low temperature expansion coefficient within the temperature range of the intended use and be transparent to visible light. Examples of such materials are polycarbonates.

The cavity is shaped to form symbols representing the information to be displayed. This means that when the volume of the cavity is filled with coloured fluid, the coloured fluid will be visible as the information, i.e. the contours of the cavity coincide with the contours of the symbols or geometry which constitute/represent the information to be displayed. The information to be displayed may be any kind of information, such as traffic signs, traffic information, commercial information, etc., represented as symbols, letters, numbers, etc. The cavity is integrated in the display body in such a way that the information is not visible or only barely visible when the cavity is empty. When coloured fluid is circulated by means of the pump, the cavity is filled by the coloured fluid, thus making the information visible. The cavities may be made as recesses in the display body material itself, or may be made separately as separate devices or layers, and the display body material might be subsequently connected to or added to the cavities. The colour of the fluid may depend on the information to be displayed and the requirements for visibility, such as contrast, sharpness, etc.

According to one or more embodiments of the present invention, the interaction between the surface of the cavity and the fluid is non-wetting. Wetting is the ability of a liquid to maintain contact with a solid surface, resulting from intermolecular interactions when the two are brought together. The degree of wetting (wettability) is determined by a force balance between adhesive and cohesive forces.

Non-wetting means in this description that the contact angle between a drop of fluid and the solid material (the surface of the cavity) is between 90 and 180 degrees. The non-wetting property of the cavity facilitates the removal of coloured liquid when circulating the fluid, thus removing the visibility of the information from the display device.

According to one or more embodiments of the present invention there are two cavities which constitute/represent two digits of a number. In one or more other embodiments the two cavities may constitute two letters of a word or there may be a number of cavities, where each cavity constitutes/represents any letter or digit of a text or number.

The different cavities may be arranged in the same layer, or in two or more layers, each layer comprising one single letter/digit or where each layer comprises two or more letters/digits.

The cavities may be segments of a seven-segment display which may be filled individually. The segments may be arranged in the same layer or in different layers. Such seven-segment displays can be used to show numbers and letters. The cavities may also represent fourteen-segment or sixteen-segment displays or pixel matrixes. In this way letters of the Latin, Cyrillic and Greek alphabets including punctuation, as well as numbers may be displayed. Nearly any kind of information may be represented on the display device.

The pump moves and/or circulates the fluid in the closed fluid circuit when the information on the display is to be changed. A pump should in this description be understood as a device used to move fluids, such as liquids, gases or slurries and may be any device that displaces a volume by physical or mechanical action. The pumps may be any suitable pump such as a direct lift, displacement, or gravity pump.

According to one or more embodiments of the present invention the pump is a hose pump, tube pump or other peristaltic pump which is reliable and eliminates the need for further valves. The pump may in one or more embodiments be implemented in the cavity by changing the shape and/or volume of the cavity. This may for example be done by means of a movable wall in the cavity. For example may the rear wall of the cavity be moved forward to remove fluid/liquid from the cavity while the rear wall may be moved backwards to introduce fluid into the cavity, thus making the symbol visible.

As the fluid circuit is closed, the coloured fluid is not contaminated and the display device may be used for a prolonged period without need for refilling with fluid. The supply fluid lines are arranged between the fluid reservoir and the cavities and a flow of fluid from the fluid reservoir supplies the cavities with coloured fluid when desired, while the return fluid lines are connected between the cavities and the fluid reservoir, and return fluid to the reservoir from the cavities. In one embodiment the supply and return fluid lines may be the same fluid lines.

When no information is to be displayed, the fluid is stored in the fluid reservoir and possibly other parts of the fluid circuit. When the information is to be displayed, the pump circulates the fluid until fluid reaches, and completely or substantially fills the cavities to be filled, then stops the circulation.

According to one or more embodiments of the present invention, the display device comprises a computer or other processing device for controlling the pump and the circulation of the fluid. The display device may also comprise sensors, such as fluid level sensors or flow sensors in order to provide feedback to the processing device. Fluid level sensors may be arranged in the cavities or other locations in the fluid circuit, for example in the supply fluid lines and/or return fluid lines.

The properties of the fluid should be adapted to the intended use of the display device. In one or more embodiments, the coloured fluid is a fluid which is fluent over a temperature range between −40 degrees Celsius and +60 degrees Celsius. In another embodiment the coloured fluid is a fluid which is fluent over a temperature range between −50 degrees Celsius and +80 degrees Celsius. The fluid may also be a non-corrosive fluid or a fluid which is inert or not aggressive towards the material of the display body and/or the cavity, and may be an environmental friendly substance. In one or more embodiments, two non-mixable fluids may be used, where one fluid is coloured and the second is clear/transparent. In this case, the system is adapted to pump the coloured fluid into the cavities when information is to be displayed, and the transparent fluid is pumped into the cavities when no information is to be displayed.

BRIEF DESCRIPTION OF THE DRAWINGS

One or more embodiments of the present invention will now be described by means of an example and with reference to the accompanying figures.

DETAILED DESCRIPTION

Hereinafter, embodiments of the invention will be described with reference to the drawings. However, the present invention is not limited to sizes, materials, shapes, relative dispositions and the like of the components described in the following embodiments and examples. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
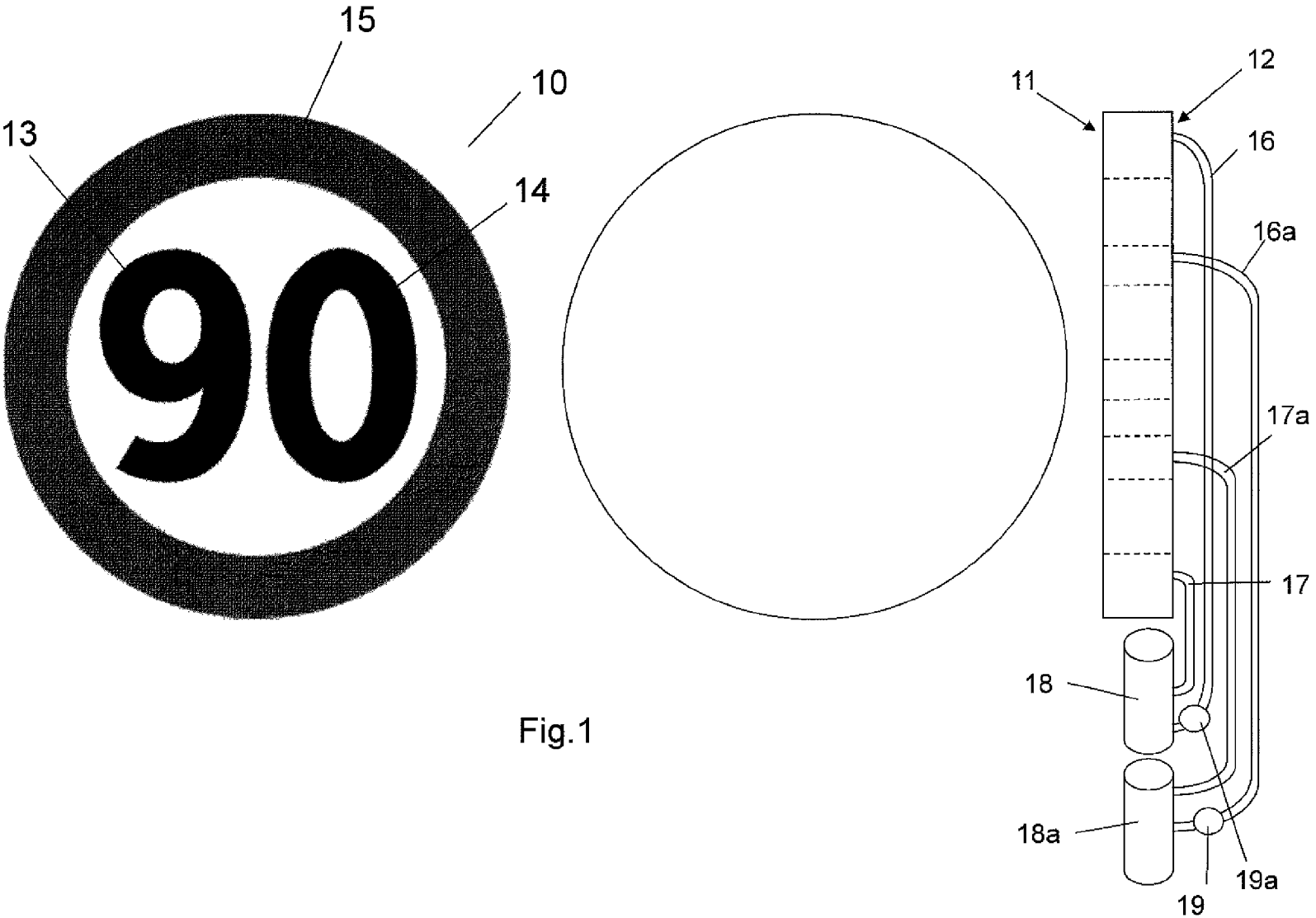
FIG. 1 shows a display device according to one or more embodiments of the invention.

FIG. 1 shows one or more embodiments of a display device in the form of a road sign, which comprises a display body 10 having a front side 11 and rear side 12 and comprising three cavities 13, 14, 15. The cavities are shaped to form symbols representing the information to be displayed, in this case the three cavities form the number ninety composed of two digits; nine and zero 13, 14, and an annular edge 15. The cavities are connected in a closed fluid circuit comprising supply fluid lines 16, 16*a*, return fluid lines 17, 17*a*, and fluid reservoirs 18, 18*a*, and contain a coloured fluid. The fluid circuit is connected to pumps 19, 19*a* for circulating the coloured fluid in the fluid circuit. In this embodiment, the fluid circuit connected to the number ninety comprises a black fluid, while the fluid circuit connected to the annular edge comprises a red fluid. Alternatively the annular edge may be permanent by means of a foil or paint arranged at the front or rear side of the display device. In this embodiment, the digits nine and zero are arranged in the same closed fluid circuit and are filled simultaneously, but the two digits may in other embodiments constitute separate fluid circuits and be filled individually.

When the cavities are filled with the fluid, i.e. fluid is pumped from the reservoirs into the cavities and kept there, the display device displays the information, in this case a traffic sign showing the speed limit. In periods where no information is to be displayed, i.e. in periods with other or no speed limits, the fluid is pumped out of the cavities.

Figure 2:
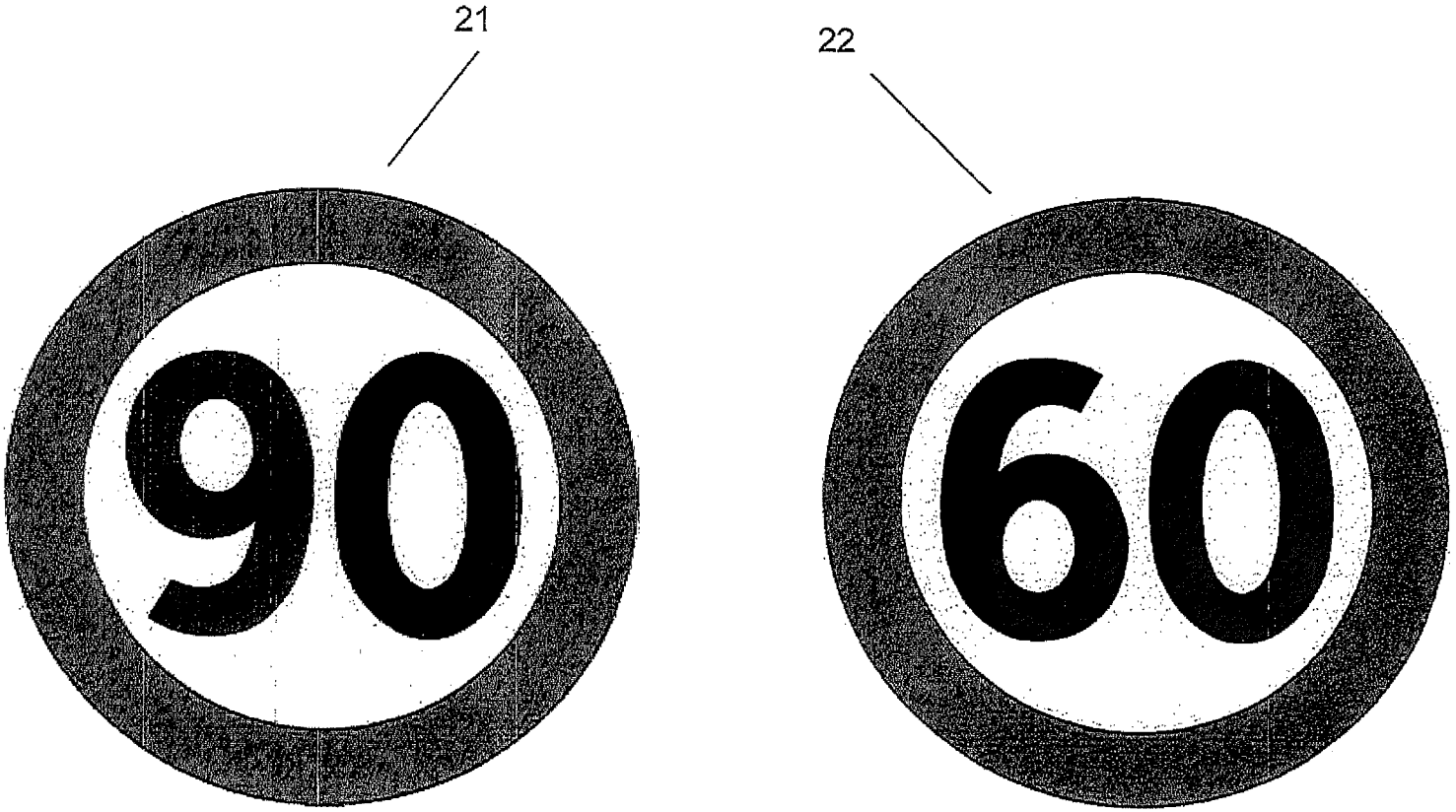
FIG. 2 shows a display device according to one or more embodiments of the invention.

FIG. 2 shows a display device according to one or more embodiments of the present invention having two states which is capable of displaying two different numbers, ninety 21 and sixty 22.

Figure 3:
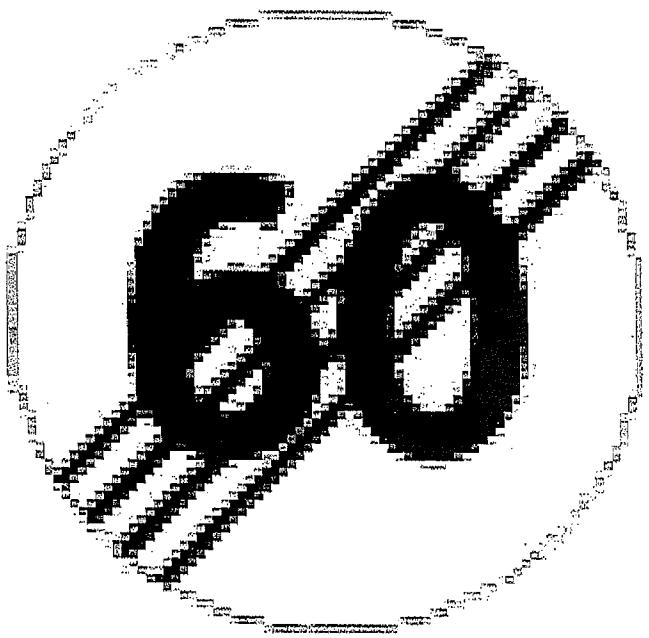
FIG. 3 shows a display device according to one or more embodiments of the invention.
Figure 3:
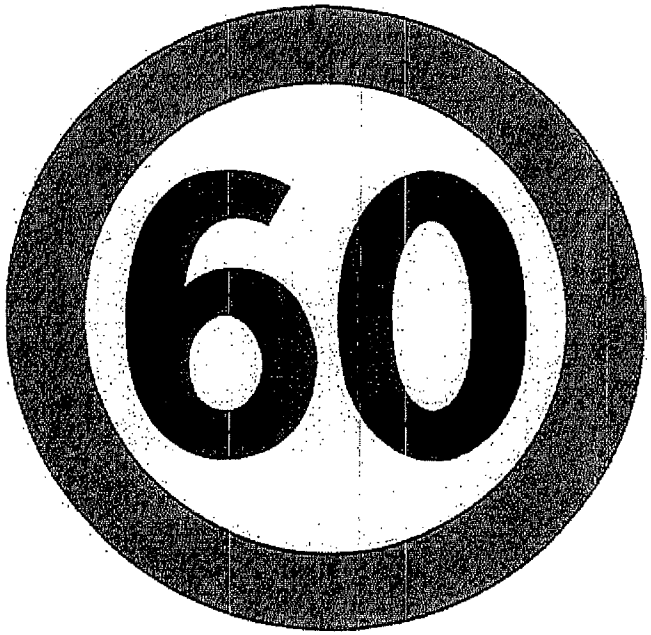

FIG. 3 shows one or more embodiments of a display device having two states, this display showing the speed limit sixty and traffic sign indicating end of speed limit.

Figure 4:
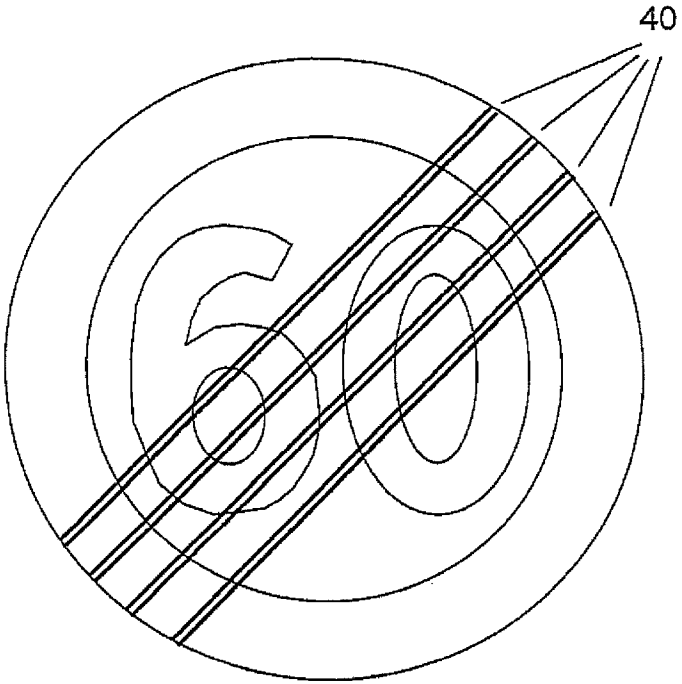
FIG. 4 shows schematically one or more embodiments of the design of the display device of FIG. 3.

FIG. 4 shows schematically the design of the display device of FIG. 3 according to one or more embodiments of the present invention. The number sixty is displayed in both states, i.e. the cavities forming both digits six and zero are filled, while the cavities forming the sloping lines 40 are filled in one state and empty in the other state.

Figure 5:
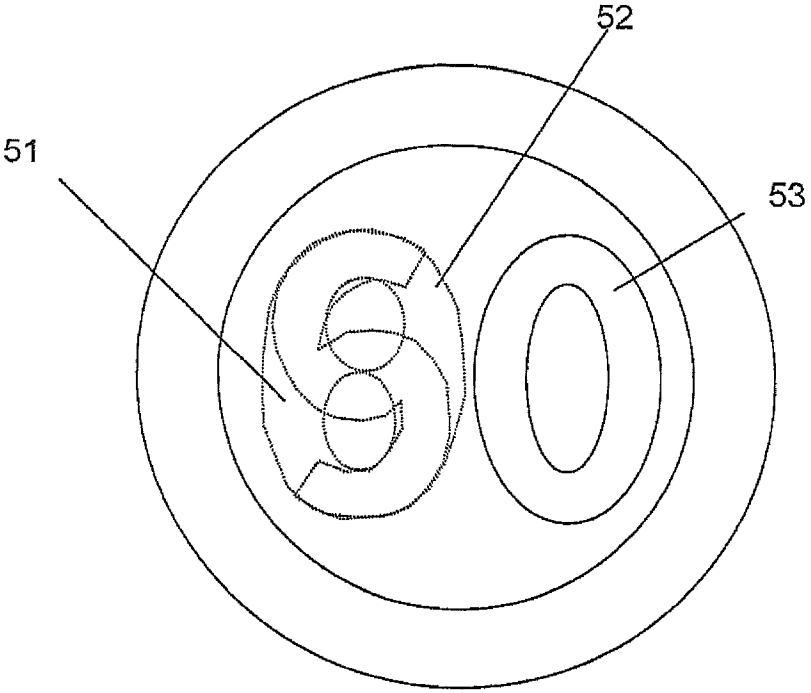
FIG. 5 shows schematically one or more embodiments of the design of the display device of FIG. 2.

FIG. 5 shows schematically the design of the display device of FIG. 2 according to one or more embodiments of the present invention. The two digits nine and six, forming the numbers ninety and sixty respectively, are arranged overlapping in two separate layers. In order to display the number ninety, the cavity 52 forming nine is filled while the cavity 51 forming six is empty. To display the number sixty, the cavity 51 forming six is filled while the cavity 52 forming nine is emptied. In both cases the cavity 53 forming zero is filled, this cavity being connected to both the nine-shaped and the six-shaped cavity through valves, or being arranged in separate fluid circuits.

Figure 6B:
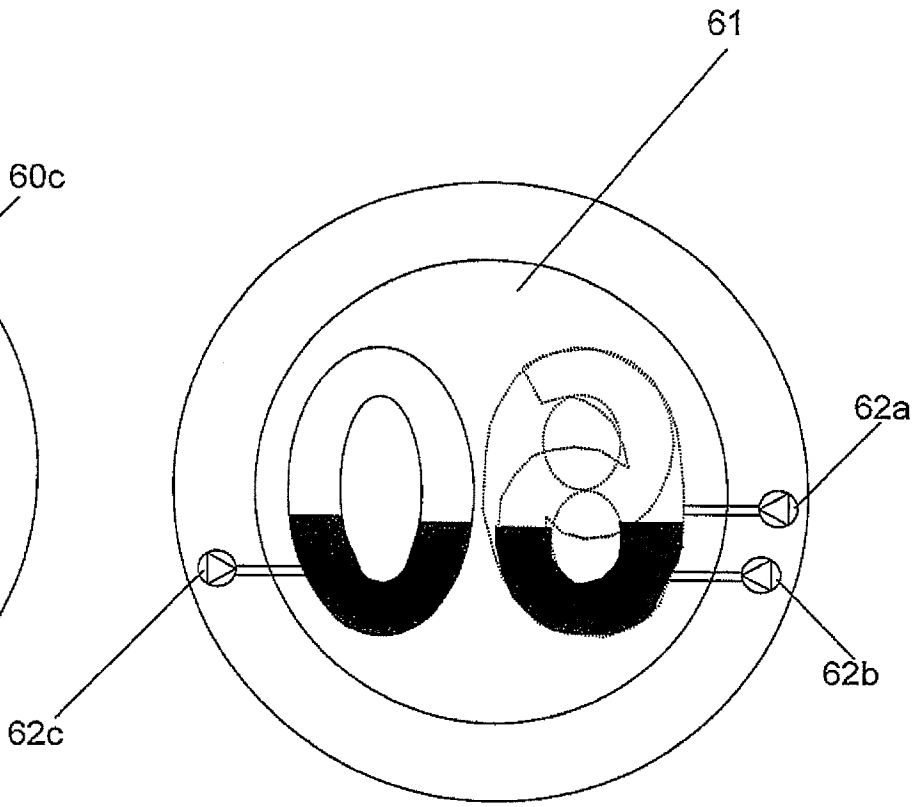
FIGS. 6*a* and 6*b* further illustrate one or more embodiments of the display device of FIG. 2 and FIG. 5.
Figure 6A:
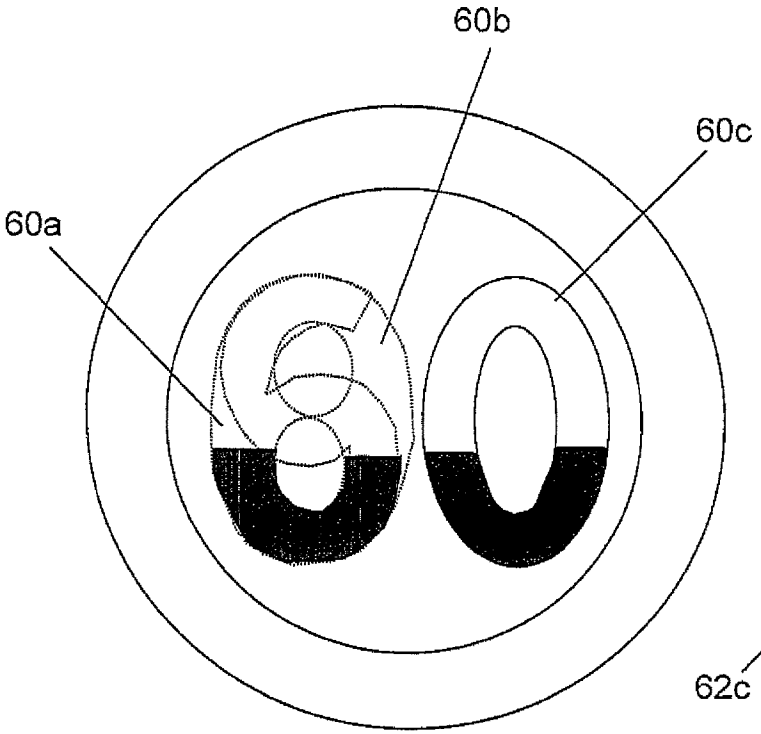

FIGS. 6*a* and 6*b* further illustrate the display device of FIG. 2 and FIG. 5 according to one or more embodiments of the present invention. FIG. 6*a* shows the front side, while FIG. 6*b* shows the rear side. At the rear side 61 parts of the fluid circuits are shown. In this embodiment, the three cavities 60*a*, 60*b*, 60*c* forming the digits six, nine and zero are arranged in separate fluid circuits and each has a respective pump 62*a*, 62*b*, 62*c*. The figures show the display during filling the cavities forming the number sixty where the cavities are partly filled.

Figure 7:
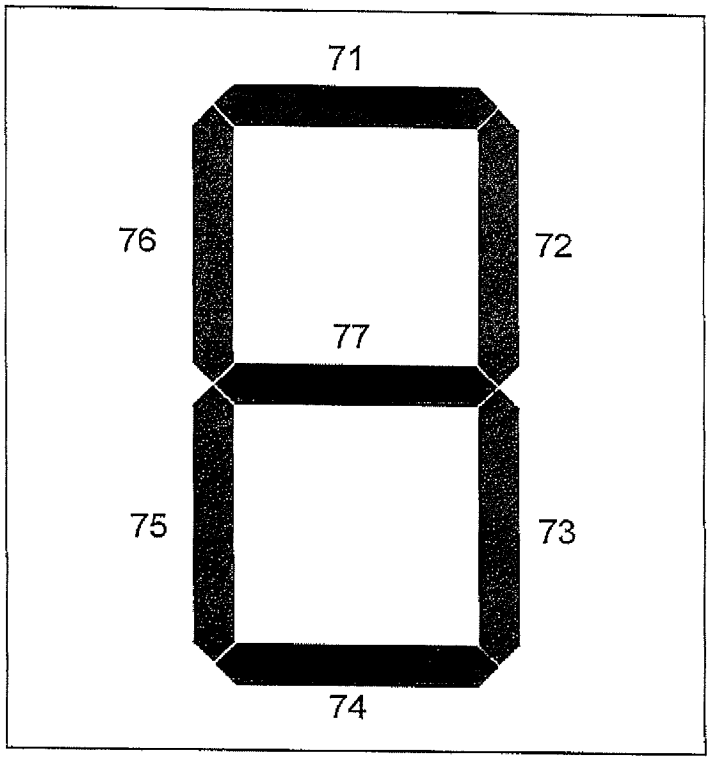
FIG. 7 shows a display device having seven separate cavities according to one or more embodiments of the invention.

FIG. 7 shows a display device according to one or more embodiments of the present invention having seven separate cavities 71-77, where each cavity constitutes a part/section of a seven-section display which may be filled individually in order to form any number or letter. In the figure all seven cavities 71-77 are filled, thus forming the number eight. The cavities may form individual, separate fluid circuits, or may be connected in the same fluid circuit, but each cavity being connected through a valve in order to choose the cavity to fill.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A display device for displaying information comprises:

a display body having a front side and rear side and comprising at least one cavity between the front side and the rear side, wherein the at least one cavity is connected in a closed fluid circuit comprising:

supply fluid lines;

return fluid lines; and a fluid reservoir, wherein the circuit is suitable to contain a coloured fluid, and wherein the at least one cavity is shaped to form symbols representing the information to be displayed; and a pump to circulate coloured fluid in the fluid circuit to supply the one or more cavities with coloured fluid and to remove the coloured fluid from the one or more cavities such that the one or more cavities are void of the coloured fluid.

2. The display device according to claim 1, wherein the interaction between the inner surface of the cavity and the fluid is non-wetting.

3. The display device according to claim 2, wherein there are two cavities which are shaped to form two digits of a number.

4. The display device according to claim 2, wherein the cavities are sections of a seven-section display which may be filled individually by the coloured fluid of the fluid circuit.

5. The display device according to claim 2, wherein the pump is a hose pump.

6. The display device according to claim 1, wherein there are two cavities which are shaped to form two digits of a number.

7. The display device according to claim 6, wherein the cavities are sections of a seven-section display which may be filled individually by the coloured fluid of the fluid circuit.

8. The display device according to claim 1, wherein a number of cavities are arranged in two or more layers, each layer comprising one selected from a single letter, digit, and symbol.

9. The display device according to claim 8, wherein the cavities are sections of a seven-section display which may be filled individually by the coloured fluid of the fluid circuit.

10. The display device according to claim 1, wherein the cavities are sections of a seven-section display which may be filled individually by the coloured fluid of the fluid circuit.

11. The display device according to claim 1, wherein the pump is a hose pump.

12. The display device according to claim 1, wherein the display body is at least partly transparent.

13. The display device according to claim 1, wherein the rear surface of the display body is covered by a colour.

14. The display device according to claim 1, wherein the display body is made of a plastic material.

15. The display device according to claim 1, wherein the fluid is fluent over a temperature range between −50 degrees Celsius and +80 degrees Celsius.

16. The display device according to claim 1, wherein the fluid is a non-corrosive fluid.

17. The display device according to claim 1, further comprising a light source.

18. The display device according to claim 1, comprising at least two cavities, wherein each cavity is connected to and comprised in a separate closed fluid circuit, and where the fluid in the fluid circuit have different colours.

19. The display device according to claim 1, further comprising a coloured fluid in the closed circuit.

20. The display device as claimed in claim 19, wherein the coloured fluid is liquid.

* * * * *